United States Patent [19]

Price

[11] Patent Number: 4,634,289

[45] Date of Patent: Jan. 6, 1987

[54] CLOCK CONSTRUCTION, GENEVA CLUTCH THEREFOR AND METHODS OF MAKING THE SAME

[75] Inventor: Larry V. Price, Knoxville, Tenn.

[73] Assignee: Robertshaw Controls Company, Richmond, Va.

[21] Appl. No.: 796,902

[22] Filed: Nov. 12, 1985

[51] Int. Cl.[4] ..... G04B 19/02

[52] U.S. Cl. ..... 368/220; 368/222

[58] Field of Search ..... 368/107–109, 368/191–193, 76, 78, 222

[56] References Cited

U.S. PATENT DOCUMENTS

| | | | |
|---|---|---|---|
| 3,899,872 | 8/1975 | Flumm et al. | 368/222 |
| 3,931,705 | 1/1976 | Iwaki et al. | 368/222 |
| 4,005,570 | 2/1977 | Miyamoto et al. | 368/235 |
| 4,057,959 | 11/1977 | Insley et al. | 368/222 |
| 4,175,373 | 11/1979 | Miyamoto et al. | 368/222 |

*Primary Examiner*—Vit W. Miska

*Attorney, Agent, or Firm*—Candor, Candor & Tassone

[57] ABSTRACT

A clock construction, a Geneva clutch therefor and methods of making the same are provided, the clock construction comprising a frame, a drive unit carried by the frame, a time indicating unit carried by the frame, and a Geneva clutch carried by the frame and operatively interconnecting the drive unit to the time indicating unit so that the drive unit can drive the time indicating unit in a timed sequence thereof, the clutch comprising a shaft rotatably carried by the frame, a pair of leaf springs each having opposed ends with a longitudinal axis therebetween, one of the opposed of each leaf spring being fixed to the shaft so that the leaf springs rotate in unison therewith, and a Geneva pinion rotatably disposed on the shaft and having a multi-sided section engaged by the leaf springs to tend to cause the shaft to rotate in unison with the pinion about an axis of rotation as the pinion is being rotated by the drive unit, the leaf springs each having the longitudinal axis thereof disposed substantially transverse to the axis of rotation of the shaft and the pinion. The other opposed ends of the leaf springs extending in opposite directions relative to each other.

24 Claims, 18 Drawing Figures

CLOCK CONSTRUCTION, GENEVA CLUTCH THEREFOR AND METHODS OF MAKING THE SAME

BACKGROUND OF THE INVENTION

1. Field of the Invention

This invention relates to a new clock construction and to a new Geneva clutch means therefor as well as to new methods of making such a clock construction and such a Geneva clutch means.

2. Prior Art Statement

It is known to provide a clock construction comprising a frame means, drive means carried by the frame means, time indicating means carried by the frame means, and a Geneva clutch means carried by the frame means and operatively interconnecting the drive means to the time indicating means so the drive means can drive the time indicating means in a timed sequence thereof, the clutch means comprising a shaft rotatably carried by the frame means, a pair of leaf spring means each having opposed end means with a longitudinal axis therebetween, one of the opposed end means of each leaf spring means being fixed to the shaft so that the leaf spring means rotates in unison therewith, and a Geneva pinion rotatably disposed on the shaft and having a multi-sided section engaged by the leaf spring means to tend to cause the shaft to rotate in unison with the pinion about an axis of rotation as the pinion is being rotated by the drive means, the leaf spring means each having the longitudinal axis thereof disposed substantially transverse to the axis of rotation of the shaft and the pinion. For example, see FIG. 10 of the drawings of this application.

It is also known to provide a clock construction comprising a frame means having a front panel means, drive means carried by the frame means, time indicating means carried by the frame means, and a Geneva clutch means carried by the frame means behind front panel means thereof and operatively interconnecting the drive means to the time indicating means so that the drive means can drive the time indicating means in a timed sequence thereof, the clutch means comprising a shaft rotatably carried by the frame means, leaf spring means being normally frictionally fixed to the shaft so that the leaf spring means normally rotates in unison therewith, and a Geneva pinion rotatably disposed on the shaft and having a multi-sided section engaged by the leaf spring means to tend to cause the shaft to rotate in unison with the pinion about an axis of rotation as the pinion is being rotated by the drive means.

SUMMARY OF THE INVENTION

It is one feature of this invention to provide a new clock construction that has a new Geneva clutch means of this invention that provides substantial torque between the leaf spring means thereof and the Geneva pinion thereof when the Geneva pinion is being driven in a driving direction by the drive unit of the clock construction and which permits a substantial reduction in the force therebetween when the time indicating means is being manually reset through the clutch means.

In particular, it was found according to the teachings of this invention that the prior known Geneva clutch means for the prior known clock construction required the same force to manually reset the time indicating drum means through the Geneva clutch means thereof as the force that is required to drive the time indicating drum means through the Geneva clutch means for time of day indicating purposes.

However, it was found according to the teachings of this invention, that the pair of leaf spring means can be uniquely arranged relative to the Geneva pinion of a Geneva clutch means so that the free ends of the pair of leaf spring means extend in opposite directions relative to each other so as to provide the aforementioned feature in a manner hereinafter shown and described.

For example, one embodiment of this invention provides a clock construction comprising a frame means, drive means carried by the frame means, time indicating means carried by the frame means, and a Geneva clutch means carried by the frame means and operatively interconnecting the drive means to the time indicating means so that the drive means can drive the time indicating means in a timed sequence thereof, the clutch means comprising a shaft rotatably carried by the frame means, a pair of leaf spring means each having opposed end means with the longitudinal axis therebetween, one of the opposed end means of each leaf spring means being fixed to the shaft so that the leaf spring means rotates in unison therewith, and a Geneva pinion rotatably disposed on the shaft and having a multi-sided section engaged by the leaf spring means to tend to cause the shaft to rotate in unison with the pinion about an axis of rotation as the pinion is being rotated by the drive means, the leaf spring means each having the longitudinal axis thereof disposed substantially transverse to the axis of rotation of the shaft and the pinion. The other opposed end means of the leaf spring means extend in opposite directions relative to each other.

It is another feature of this invention to provide means for readily adjusting the time indicating means of such a clock construction.

In particular, it was found according to the teachings of this invention that when adjusting the minute drum of the clock construction so that its respective numeral will be properly aligned in its window of the clock construction, the shaft that carries the Geneva clutch means must be rotated relative to the spring means of such clutch means and that this can be accomplished by holding the spring means from rotation while the shaft is being rotated relative thereto during such minute drum adjustment.

However, it was also found that in the prior known clock construction, the spring means must be held by reaching through the rear of the frame means of the clock construction.

Therefore, it was found according to the teachings of this invention that unique access means could be provided in the front panel of the frame means for the purpose of providing ready access to the spring means of the Geneva clutch means for holding the spring means during the adjustment of the minute drum of the clock construction.

For example, another embodiment of this invention provides a clock construction comprising a frame means having a front panel means, drive means carried by the frame means, time indicating means carried by the frame means, and a Geneva clutch means carried by the frame means behind the front panel means thereof and operatively interconnecting the drive means to the time indicating means so that the drive means can drive the time indicating means in a timed sequence thereof, the clutch means comprising a shaft rotatably carried by the frame means, leaf spring means being normally frictionally fixed to the shaft so that the leaf spring means normally rotates in unison therewith, and a Geneva pinion rotatably disposed on the shaft and having a multi-sided section engaged by the leaf spring means to tend to cause the shaft to rotate in unison with the pinion about an axis of rotation as the pinion is being rotated by the drive means. The frame means has externally accessible access means in the front panel means thereof for permitting the holding of the spring means while the shaft is rotated relative to the thus held spring means by an adjustment being made to the time indicating means that causes such rotation of the shaft.

Accordingly, it is an object of this invention to provide a new clock construction having one or more of the novel features of this invention as set forth above or hereinafter shown or described.

Another object of this invention is to provide a new method of making such a clock construction, the method of this invention having one or more of the novel features of this invention as set forth above or hereinafter shown or described.

Another object of this invention is to provide a new Geneva clutch means for a clock construction, the Geneva clutch means of this invention having one or more of the novel features of this invention as set forth above or hereinafter shown or described.

Other objects, uses and disadvantages of this invention are apparent from a reading of this description which proceeds with reference to the accompanying drawings forming a part thereof and wherein:

DESCRIPTION OF THE PREFERRED EMBODIMENTS

Figure 1:
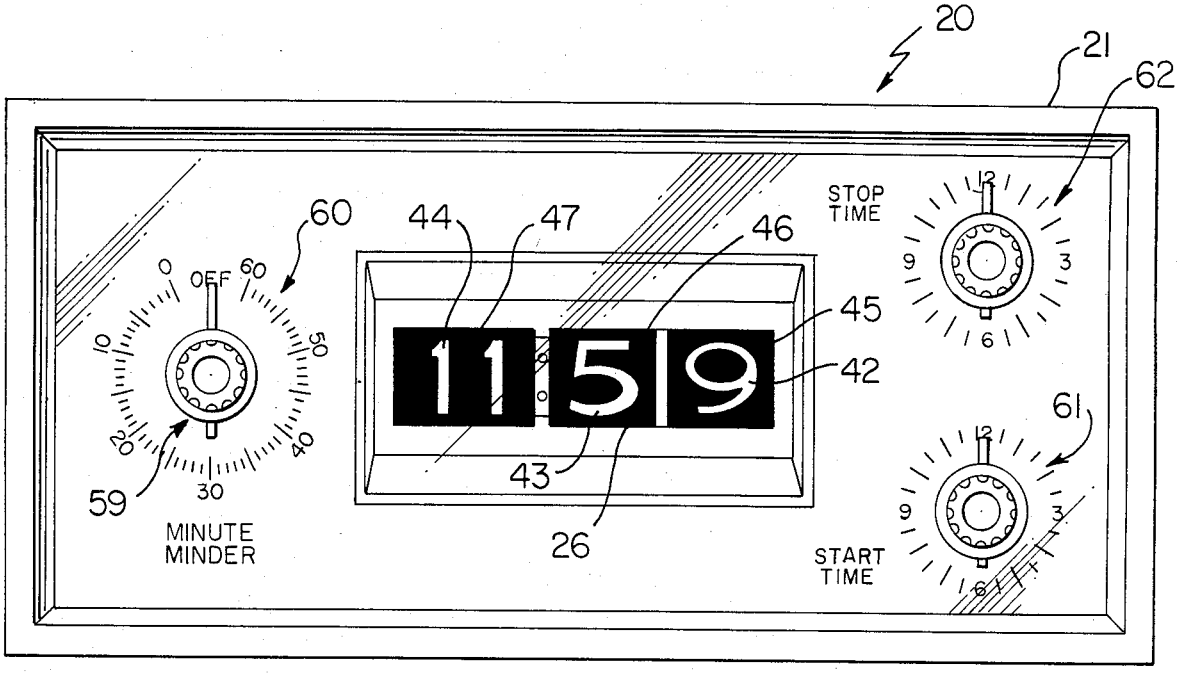
FIG. 1 is a front view of the new clock construction of this invention.

While the various features of this invention are hereinafter illustrated and described as being particularly adapted to provide a digital clock construction for a cooking apparatus, it is to be understood that the various features of this invention can be utilized singly or in various combinations thereof to provide a clock construction of a different type and/or for a different use thereof.

Therefore, this invention is not to be limited to only the embodiments illustrated in the drawings, because the drawings are merely utilized to illustrate one of the wide variety of uses of this invention.

Figure 2:
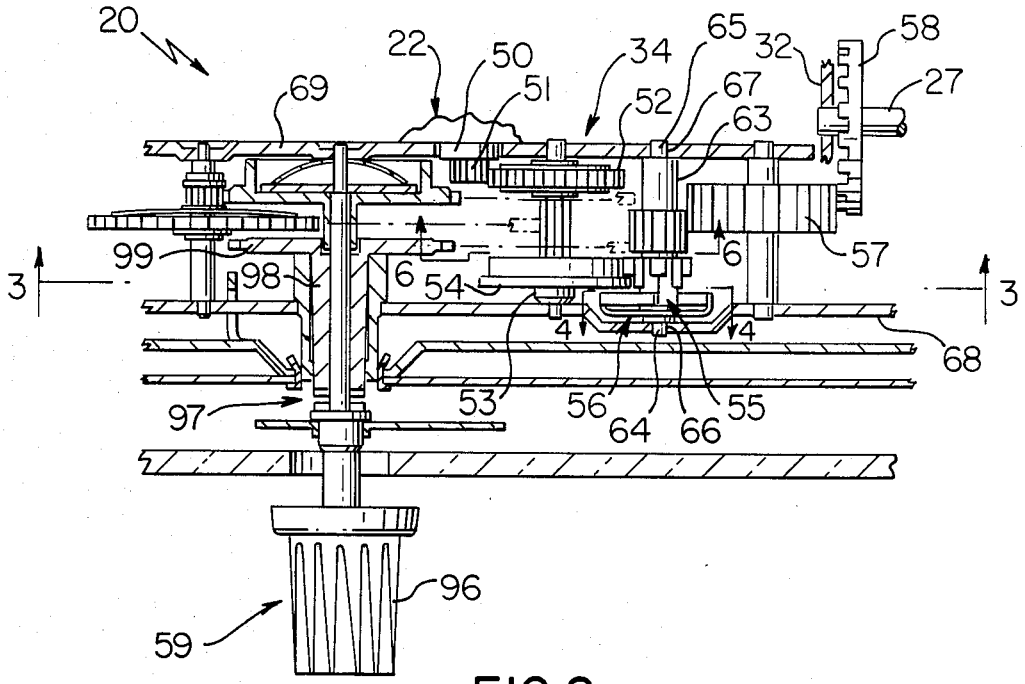
FIG. 2 is an enlarged, fragmentary cross-sectional view and schematically illustrates the drive structure of the clock construction of FIG. 1, FIG. 2 being taken generally in the direction of the arrows 2—2 of FIG. 1.
Figure 3:
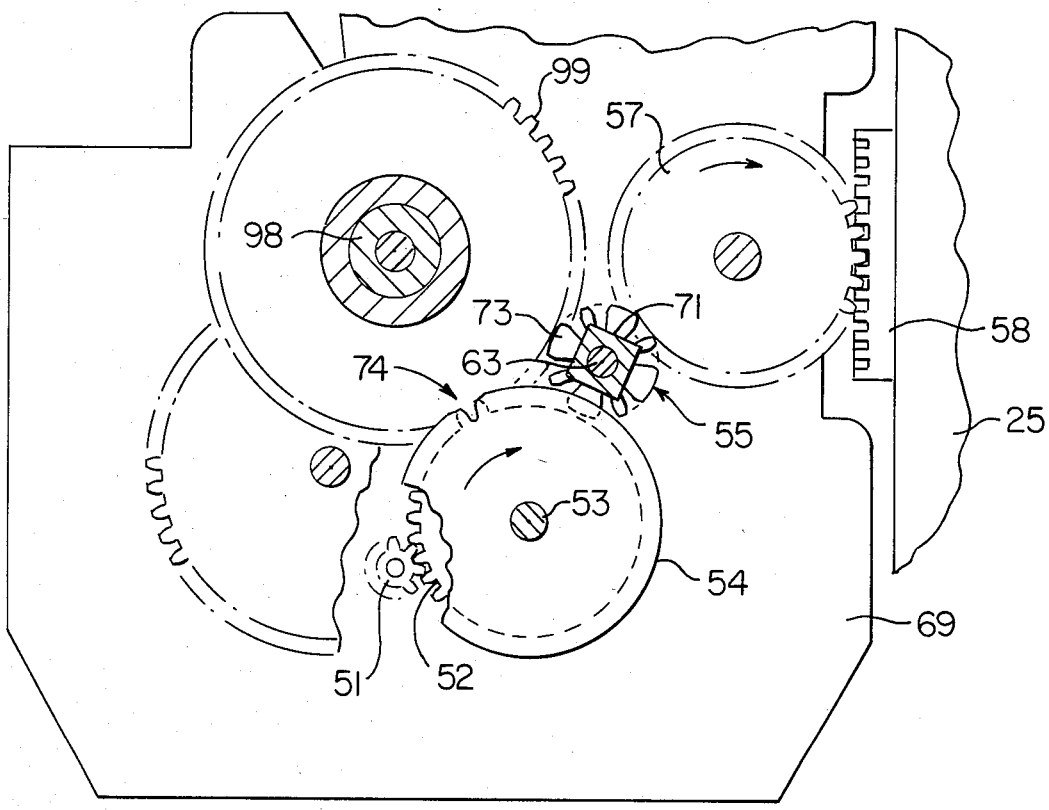
FIG. 3 is an enlarged, fragmentary cross-sectional view taken on line 3—3 of FIG. 2.

Referring now to FIGS. 1, 2 and 3, one embodiment of the new clock construction of this invention is generally indicated by the reference numeral 20 and comprises a frame means 21 carrying an electrically operated motor means that is conventional in the art and is generally indicated by the reference numeral 22, FIG. 2, the motor means 22 driving in a timed sequence in a manner hereinafter set forth a plurality of time indicating drum means 23, 24 and 25 that are carried by the frame means 21 and indicate the time of day in a window means 26 of the clock construction 20 as illustrated in FIG. 1.

The drum means 23–25 are respectively disposed on a shaft means 27, FIG. 7, that has opposed ends 28 and 29 thereof rotatably disposed in suitable openings 30 and 31 formed in frame parts 32 and 33 of the frame means 21 so that the shaft means 27 is adapted to be rotated relative to the frame means 21 by the drive motor means 22 in a manner hereinafter described by a drive train means of the clock constructionn 20 that is generally indicated by the reference numeral 34 in FIG. 2.

The time indicated drum means 23 has a central hub 35 receiving the shaft means 27 through a central opening 36 thereof with the shaft means 27 having a knurled or spline portion 37 press-fitted into the opening 36 of the hub 35 so that the drum means 23 rotates in unison with the shaft means 27 whereas the drum means 24 and 25 are adapted to rotate relative to the shaft means 27.

In particular, the drum means 24 and 25 respectively have the shaft means 27 passing through central openings 38 and 39 of central hubs 40 and 41 thereof with the hubs 35, 40 and 41 of the drum means 23–25 being disposed in aligned stacked relation on the shaft means 27 but being movable relative to each other.

The drum means 23, 24 and 25 respectively have numbers 42, 43 and 44, FIG. 1, disposed on the outer surfaces 45, 46 and 47 thereof in a manner conventional in the art so that the drum means 23 comprises a minute indicating drum means, the drum means 24 comprises a ten minute indicating drum means and the drum means 25 comprises an hour indicating drum means whereby the clock construction 20 comprises a digital clock construction.

Figure 7:
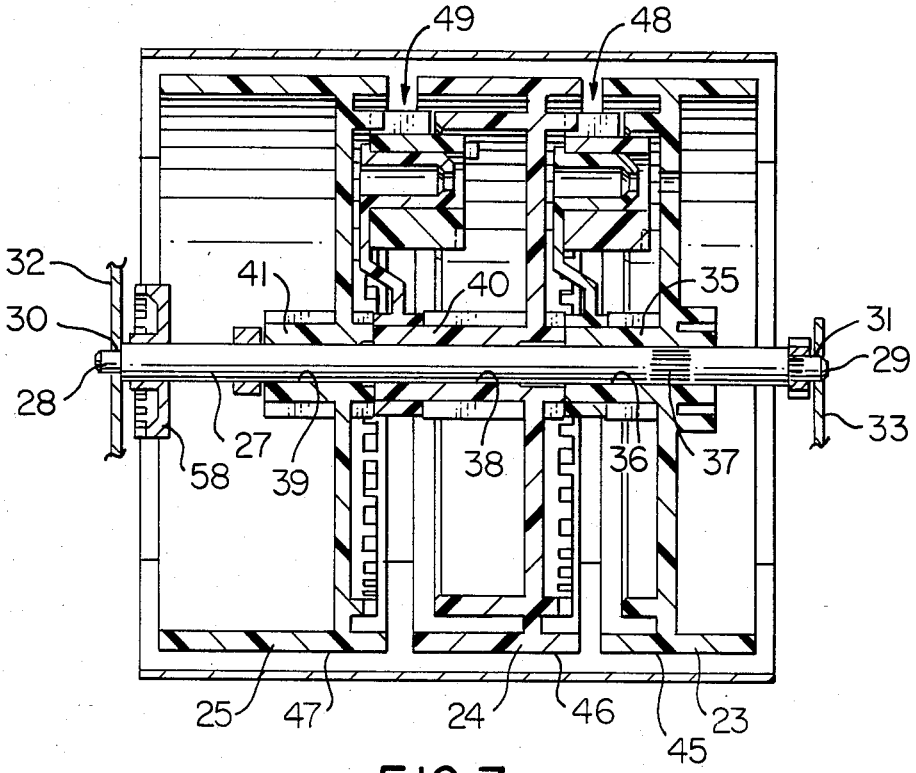
FIG. 7 is an enlarged cross-sectional view taken substantially on line 7—7 of FIG. 1 and illustrates the time indicating drum means of the clock construction of FIG. 1.
Figure 8:
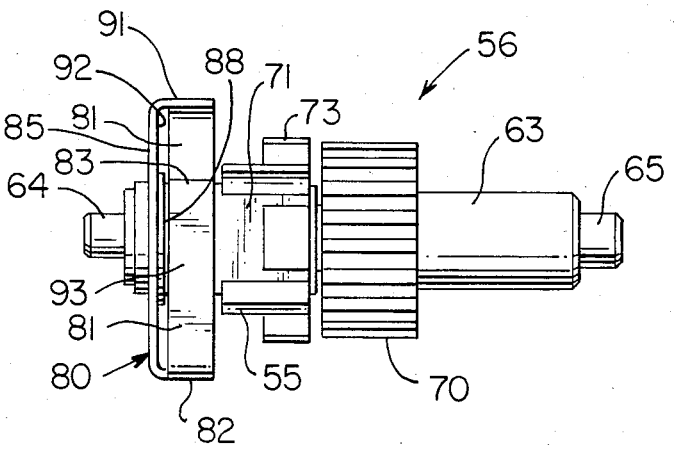
FIG. 8 is an enlarged side view of the Geneva clutch means of this invention and is generally taken in the direction of the arrows 8—8 of FIG. 2.

A pair of pinion gear means that are respectively generally indicated by the reference numerals 48 and 49 in FIG. 7 cooperate with the drive means 34 and the drum means 23–25 to cause the minute drum means 23 to intermittently rotate approximately 36° after the lapsing of each minute of time with the pinion gear means 48 causing the ten minute drum means 24 to rotate approximately 30° every tenth increment of movement of the minute drum means 23 and with the pinion gear means 49 causing the hour indicating drum means 25 to rotate approximately 30° during every sixth increment of movement of the ten minute indicating drum means 24 so that the drum means 23–25 will provide the proper time of day at the window means 26 in the manner illustrated in FIG. 1 and in a manner well known in the art. However, the particular pinion gear means 48 and 49 of the clock construction 20 are unique and are fully disclosed and claimed in the copending patent application of Alfred A. Frankenberg, Ser. No. 796,903 filed 11-12-85 whereby this copending patent application is being incorporated into this disclosure by this reference thereto.

The electrically operated motor means 22, in a manner conventional in the art, has a guide bushing 50, FIG. 2, that locates a pinion gear 51 that is continuously rotated by the motor means 22 and is disposed in meshing relation with a gear 52 fixed to a shaft means 53 that is rotatably carried by the frame means 21 and has a gear means 54 thereon that is disposed in meshing relation with a pinion gear means 55 of a Geneva clutch means 56 that drives a gear 57 that is disposed in meshing relation with a gear means 58 fixed to the shaft means 27 so that the shaft means 27 is intermittently rotated approximately 36° each minutes and thereby causes the minute indicating drum means 23 to serially change the minute indicating number 42 at the window means 26 once a minute, such each incremental movement of the shaft 27 and minute indicating drum means 23 taking place during approximately 5½ seconds.

Figure 10:
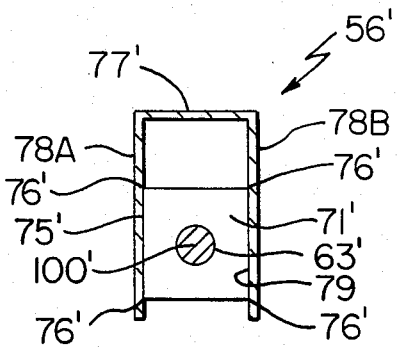
FIG. 10 PRIOR ART
FIG. 10 is a view similar to FIG. 4 and illustrates a prior known Geneva clutch means.

In general, the use of a Geneva clutch means for rotating the shaft 27 every minute is well known in the art and such prior known Geneva clutch means is generally indicated by the reference numeral 56′ in FIG. 10 wherein parts of the prior known Geneva clutch means 56′ that are similar to parts of the Geneva clutch means 56 of this invention are indicated by like reference numerals followed by a prime mark.

The clock constrution 20 has a control knob means 59, FIGS. 1 and 2, for permitting the operator to manually set the time indicating position of the drum means 23–25 even though the motor means 22 is running and such use of a time setting knob means 59 for such purpose is well known in the art whereas the particular knob means 59 of the clock construction 20 of this invention is unique and is disclosed and claimed in the copending patent application of Jay L. Lewis, Ser. No. 651,573, filed Sept. 17, 1984, whereby this copending patent application is being incorporated into this disclosure by this reference thereto.

Therefore, since the use of a Geneva clutch means to interconnect the motor means 22 to the shaft means 27 so as to intermittently rotate the shaft means 27 every minute and the use of a knob 59 to permit the operator to mechanically set the position of the drum means 23–25 while the motor means 22 is continuously operating are both well known in the art, a further discussion of the operation and structure of the drive train means 34 and the drum means 23–25 need not be set forth in order to understand the features of this invention.

However, it can be seen that the clock construction 20 of this invention comprises a range timer wherein the control knob means 59 is also adapted to set an interval timer means that is generally indicated by the reference numeral 60 in FIG. 1 with the motor means 22 operating the interval timer means 60 in a manner well known in the art. Also, the clock construction 20 has control knob means 61 and 62 as illustrated in FIG. 1 for selecting a desired start time and a desired stop time that the clock construction 20 is to operate a switch means (not shown) for completing an electrical circuit to a cooking apparatus heating means to cause that heating means to start to operate when the indicated time of day of the clock construction 20 teaches the selected start time and terminates that operation of the heating means of the cooking operation when the selected stop time is reached by the indicated time of day of the clock construction 20 in a manner well known in the art.

The Geneva clutch means 56 of this invention comprises a shaft 63 having opposed ends 64 and 65 received in suitable openings 66 and 67 formed in frame parts 68 and 69 of the frame means 21 so as to rotatably mount the shaft 63 in the frame means 21.

A pinion gear 70 is fixed to the shaft 63 so as to rotate in unison therewith with the pinion 70 being disposed in meshing relation with the previously described gears means 57 that drives the gear means 58 of the drum shaft 27.

The Geneva pinion 55 comprises a multi-sided section 71 and has opening 72 passing centrally therethrough and receiving a part 73′ of the shaft 63 therethrough so that the Geneva pinion 55 is rotatably disposed on the shaft 63, the multi-sided section 71 carrying at one and thereof a plurality of Geneva gear teeth 73 that are disposed about the periphery thereof and cooperated with the gear means 54 and a pair of gear teeth 74 thereon in a manner well known in the art in order to hold the Geneva pinion 55 from rotation and only intermittently rotate or index the Geneva pinion 55 each time the gear 54 is rotated through 360° so as to cause the drive shaft 27 to be intermittently rotated.

The multi-sided section 71 has a plurality of flat sides 75 that extend about the outer periphery thereof at the end thereof opposite to the teeth 73 with each flat side 75 joining an adjacent flat side 75 to define a corner means 76, the multi-sided section 71 having four flat sides 75 as illustrated in the drawings.

Such multi-sided section 71 is an arrangement that is well known in the art and one such multi-sided section 71′ is illustrated in FIG. 10 and normally causes the shaft 63′ thereof to rotate in unison therewith because of a leaf spring means 77 that is fixed to the shaft 63′ and has a pair of legs 78A and 78B provided with substantially flat sides 79 thereof disposed against cooperating flat sides 75′ of the multi-sided section 71′. In this manner, rotation of the section 71′ by a pinion gear means acting on the Geneva gear teeth thereof (not shown) causes the shaft 63′ to rotate in unison therewith as the leaf spring 77 operatively interconnects the section 71′ to the shaft means 63′. However, as is well known in the art, the shaft 63′ is adapted to be manually rotated relative to the section 71′ in order to reset the indicating time of the indicating drum means by utilizing the control knob means 59 in a manner hereinafter set forth whereby the legs 78A and 78B of the leaf spring 77 are adapted to respectively flex around diagonally opposite corners 76′ of the multi-sided section 71′ as the shaft 63′ is being rotated relative to the section 71′ until the desired reset time of the time indicating drum means has been reached. At this time, the legs 78A and 78B of the leaf spring 77 will now remain against opposite flat sides 75′ of the multi-sided section 71′ so as to cause a driving relation between the section 71′ and the shaft 63′ so that the same will operate in unison in the manner previously described.

Figure 11:
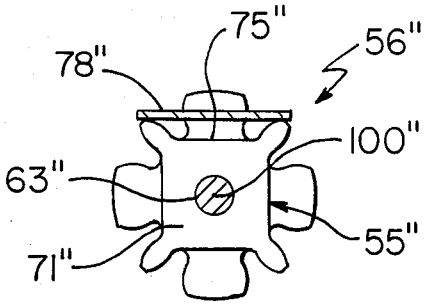
FIG. 11 PRIOR ART
FIG. 11 is a view similar to FIG. 10 and illustrates another prior known Geneva clutch means.
Figure 14:
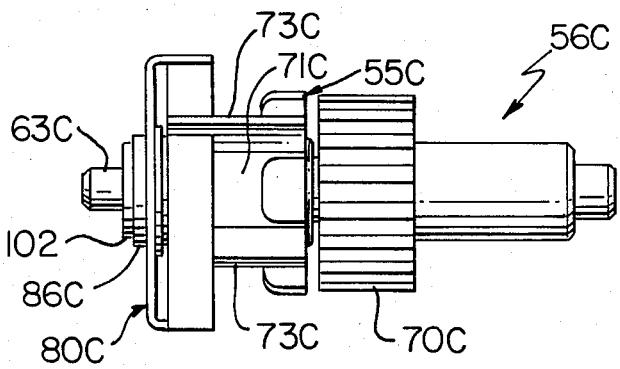
FIG. 14 is an enlarged side view of the Geneva clutch means of this invention that is utilized in the clock construction of FIG. 12.
Figure 17:
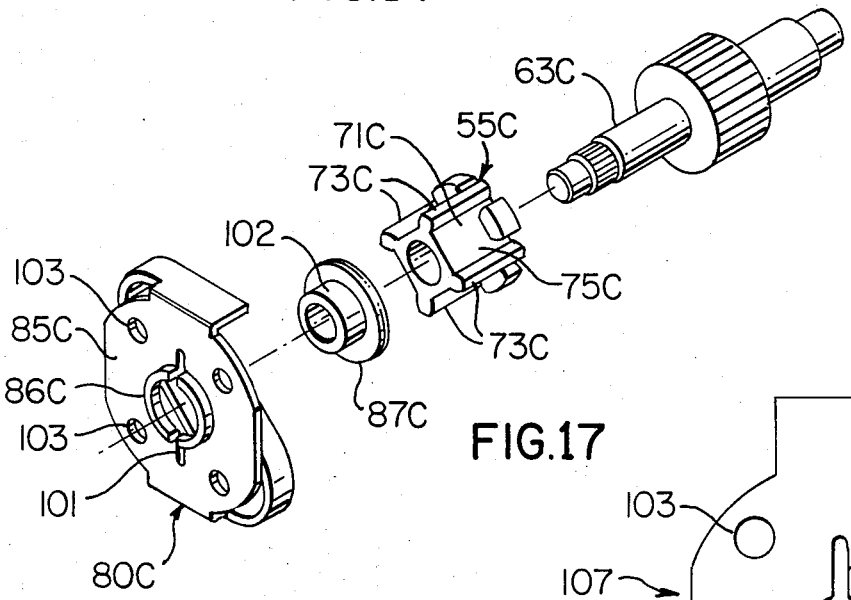
FIG. 17 is an exploded perspective view of the various parts of the Geneva clutch means of FIG. 14.

Another prior known Geneva clutch means 56″ is illustrated in FIG. 11 and parts thereof similar to the Geneva clutch means 56 of this invention are indicated by like reference numerals followed by a double prime mark, the Geneva clutch means 56″ having only a single leaf spring leg 78″ and the multi-sided section 71″ having teeth forming the corners 76″ thereof.

As previously set forth, the Geneva clutch means 56 of this invention has unique leaf spring means for interconnecting the Geneva pinion 55 to the shaft means 63 and such unique leaf spring means is generally indicated by the reference numeral 80 in the drawings and comprises a pair of leaf spring members 81 each having opposed ends 82 and 83 with a longitudinal axis 84 extending therebetween, the ends 82 of the leaf spring members 81 respectively being fixed to the shaft 63 as the same form part of an end member 85 that is fixed to the shaft 63.

In particular, the end member 85 has a central opening 86 passing therethrough and press-fittingly receives a tubular portion 87 of a spring retainer 88 therein which in turn has an opening 89 passing therethrough and is press-fittingly disposed on a reduced portion 90 of the shaft 63 so that the end member 85 and, thus, the leaf spring members 81 will rotate in unison with the shaft 63.

While the leaf spring means 80 of this invention can be formed in any suitable manner and from any suitable material, the same can be formed from a blank of metallic material (similar to FIG. 18) that is suitably stamped and bent into the configuration illustrated in the drawings so that the end member 85 has a pair of bent over tab-like parts 91 that are disposed substantially parallel to each other and extend from the side 92 of the end member 85. Each leaf spring member 81 has the end 82 thereof extending from the tab 91 and being integral therewith whereby the leaf spring means 80 comprises a one-piece member.

Figure 4:
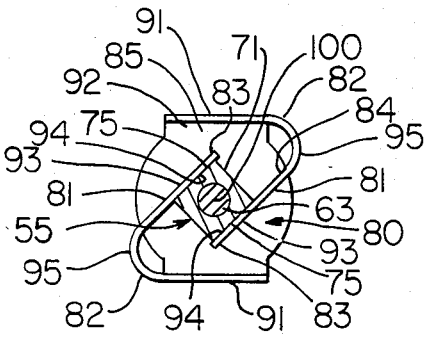
FIG. 4 is an enlarged, fragmentary cross-sectional view of the new Geneva clutch means of this invention and is taken on line 4—4 of FIG. 2.
Figure 6:
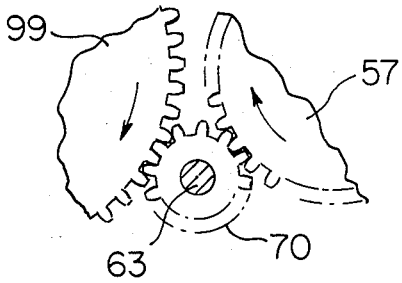
FIG. 6 is a fragmentary cross-sectional view taken on line 6—6 of FIG. 2.
Figure 9:
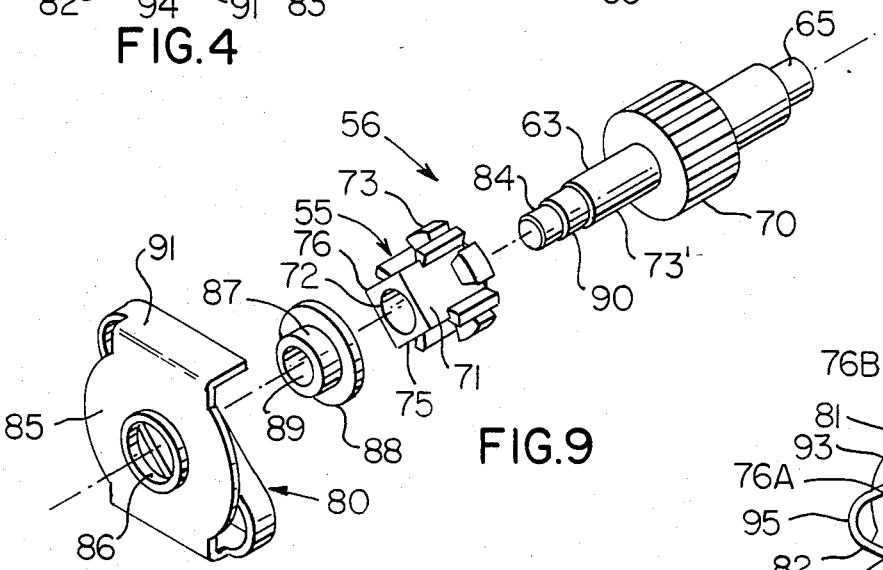
FIG. 9 is an exploded perspective view of the Geneva clutch means of FIG. 8.

The leaf spring members 81 are bent in such a manner and extend from opposite ends of the tabs 91 so that the free ends 83 thereof extend in opposite directions while the body or medial portions 93 thereof are disposed substantially parallel to each other and define substantially flat facing sides 94 as illustrated, each leaf member 81 providing an elbow 95 between the opposed ends 82 and 83 thereof whereby after the Geneva pinion 55 is disposed on the shaft 63 and the leaf spring means 80 is fixed to the shaft 63 by the retainer 87 in the manner previously described, the leaf spring members 81 respectively have the sides 94 of the medial portions 93 thereof engaging against opposed flat sides 75 of the multi-sided section 71 of the Geneva pinion 55 in the manner illustrated in FIG. 4 so that rotation of the Geneva pinion 55 causes the shaft 63 to rotate therewith as the leaf spring members 81 operatively interconnect the pinion 55 to the shaft 63. The natural force of the leaf spring members 81 is to tend to move the facing sides 94 thereof toward each other so as to fully press against the respective opposed sides 75 of the multi-sided section 71 with a desired suitable spring force whereby such spring force is sufficient to transmit sufficient torque through the leaf spring members 81 to rotate the shaft 63 upon rotation of the multi-sided section 71 and thereby drive the drive indicating drums 23–25 in a manner hereinafter set forth.

Therefore, it can be seen that the various parts of the clock construction 20 can be formed from any suitable materials in any suitable manner to form the clock construction 20 by the method of this invention previously set forth so as to operate in a manner now to be described.

With the clock construction 20 operating in a normal manner by the electrically operated motor means 22 continuously driving the shaft 53 so that the gear means 54 is rotating in the clockwise direction as illustrated in FIG. 3, once every minute the gear teeth 74 of the gear means 54 mesh with the teeth 73 of the Geneva pinion 55 to cause counterclockwise rotation thereof in FIG. 3, such rotation of the multi-sided section 71 of the Geneva pinion 55 being clockwise in FIG. 4, whereby it can been seen that the tendency of the multi-sided section 71 is to have the corners 76A thereof that are disposed closer to the fixed end means 82 of the leaf spring members 81 tend to separate the spring members 81 from each other so that relatively short lever arms are provided by the leaf spring members 81 between those corners 76A and the fixed ends 82 thereof. In this manner, substantial torque can be transmitted by the Geneva pinion 55 through the leaf spring members 81 to the shaft 63 to cause the shaft 63 to rotate therewith and through the pinion 70 thereof to rotate the pinion 57 in the clockwise direction in FIG. 3 to thereby rotate the gear 58 and shaft 27 through 36° of rotation thereof to cause the minute indicating drum means 23 to bring a new minute numeral 42 thereof into the window means 26 so that the proper time of day will be presented in the window means 26 in a manner well known in the art.

Thus, every minute, the shaft 27 is rotated in the above manner and the drum means 23–25 are thereby operated in a manner well known in the art.

Figure 5:
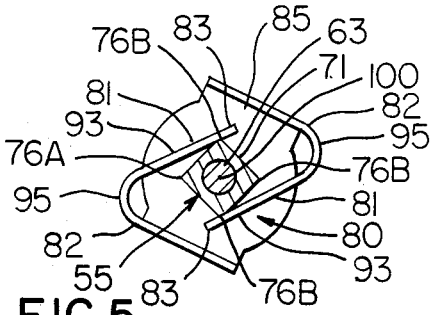
FIG. 5 is a view similar to FIG. 4 and illustrates the Geneva clutch means in another operating condition thereof.

Should the operator desire to reset the time indicated in the window means 26 so as to correct the indicated time thereof or the like, the operator utilizes the knob means 59 by pushing axially inwardly on a control knob 96 thereof in FIG. 2 so that the control knob 96, through a clutch meas 97, is interconnected to a tubular member 98 that has a gear means 99 thereon that is disposed in meshing relation with the pinion 70 of the shaft 63. Thus, subsequent rotation of the control knob 96 in a clockwise direction in FIGS. 1 and 5 will cause the shaft 63 to be rotated in a clockwise direction as illustrated in FIG. 5 and carry the leaf spring means 80 therewith in a clockwise direction about the multi-sided section 71 of the Geneva pinion 55 so as to rotate the shaft 63 independent of the Geneva pinion 55 and, thus, the drum shaft 27 to set the indicating drums 23–25 thereof into the desired position thereof even though the gear means 54 is holding and intermittently driving the Geneva pinion 55 also in a clockwise direction in FIG. 5 but at a much slower rate than the rate being used by the knob means 59 to rotate the shaft 63 and leaf spring means 80 in the clockwise direction as illustrated in FIG. 5. Such rotation of the spring means 80 in a clockwise direction about the multi-sided section 71 as illustrated in FIG. 5 causes the leaf spring members 81 to act on the corners 76B of the respective sides 75 of the multi-sided section 71 and because the corners 76B are the ones disposed furthest from the fixed ends 82 of the respective leaf members 81, relatively long moment arms are provided between those corners 76B and the fixed ends 82 of the leaf spring members 81 so as to provide for the least amount of force required to deflect the spring members 81 to permit the spring means 80 to be rotated in a clockwise direction relative to the Geneva pinion 55 in the manner illustrated in FIG. 5. In this manner, the resetting mode of the Geneva clutch means 56 of this invention requires a reduced effort whereas during the normal operation of the Geneva clutch means 56 by the motor means 22, the greatest amount of torque is provided by the other corners 76A of the multi-sided member 71 acting on the leaf members 81 and thereby acting through short moment arms of the leaf spring members 81.

This unique feature is provided by having the longitudinal axis 84 of each leaf spring member 81 being disposed substantially transverse to the axis of rotation 100 of the Geneva pinion 55 as illustrated in FIGS. 4 and 5 and by having the ends 83 of the legs or leaf spring members 81 extending in opposite directions.

In contrast, it can be seen that the longitudinal axis of the leaf spring member 77 of the prior art Geneva clutch means 56'' illustrated in FIG. 11 is disposed substantially parallel to the axis of rotation 100'' of the shaft means 63'' and the Geneva pinion 55'' so that the moment arm is exactly the same between the leaf spring member 78'' and the flat surface 75'' regardless of the relative direction of rotation between the leaf member 78'' and the pinion 55''.

In a similar manner, it can be seen that with the clutch means 56'' of FIG. 10, clockwise rotation of the section 71' in FIG. 10 causes the upper right-hand corner 76' to act on the leg 78B while the lower left-hand corner 76' acts on the leg 78A. In contrast, clockwise movement of the spring means 77 relative to the clockwise rotating section 71' causes the leg 78A to act on the upper left-hand corner 76' of the section 71' while the leg 78B acts on the lower right-hand corner 76' so that in either case, one leg has a short moment arm and the other leg has a long moment arm whereby regardless of the relative direction of rotation between the leaf spring member 77 and the section 71' of the clutch means 56', the total moment arm force is exactly the same.

Figure 18:
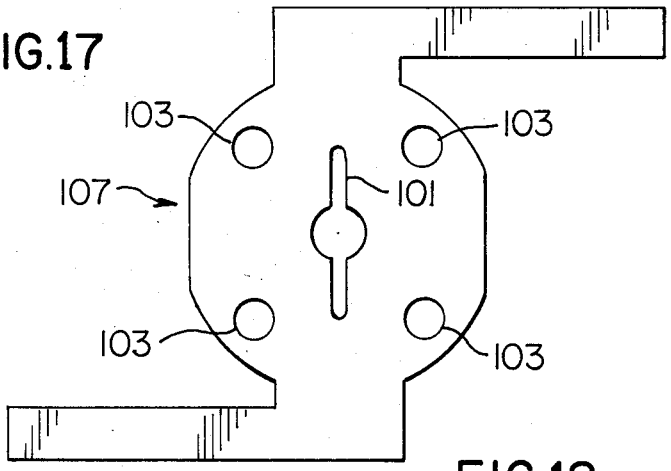
FIG. 18 is an enlarged plan view of blank of material that is utilized to form the spring means of the clutch means of FIG. 14.

Another clock construction of this invention is generally indicated by the reference numeral 20C in FIGS. 20–18 and parts thereof similar to the clock construction 20 previously described are indicated by like reference numerals followed by the reference letter "C".

Figure 12:
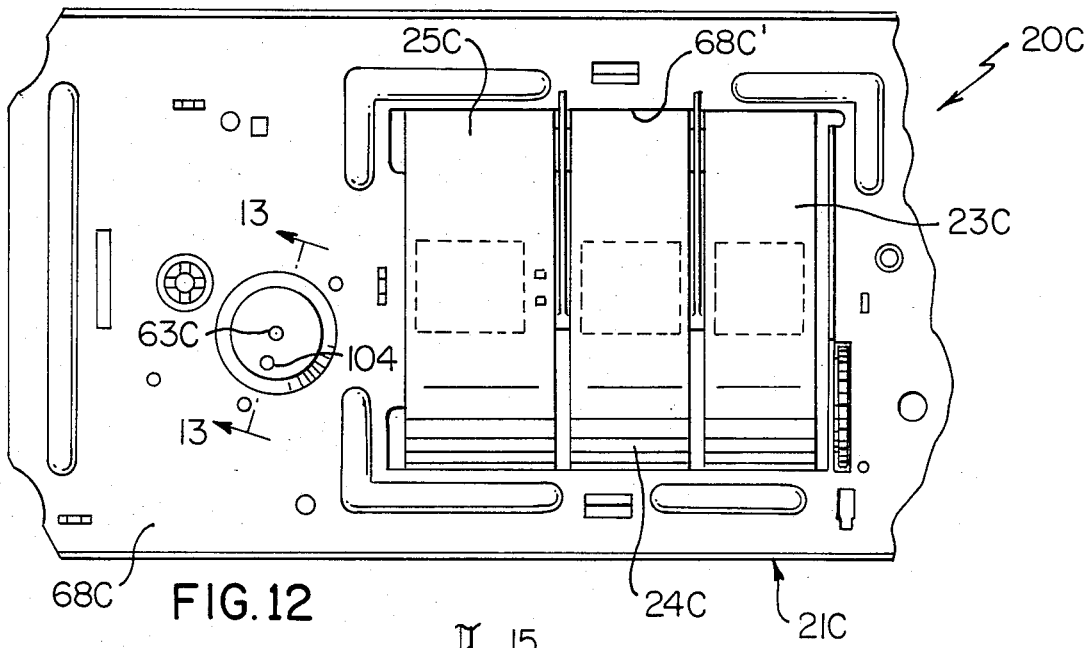
FIG. 12 is a fragmentary front view of another clock construction of this invention with the front plate means removed.
Figure 13:
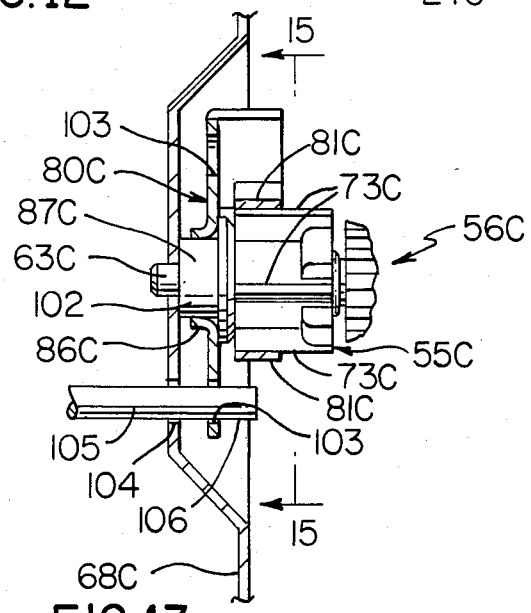
FIG. 13 is an enlarged, fragmentary cross-sectional view taken on line 13—13 of FIG. 12.

As illustrated in FIGS. 12 and 13, the frame means 21C of the clock construction 20C has the front plate 68C disposed in front of the Geneva clutch means 56C in the same manner as the plate means 68 of the clock construction 20 previously described. However, it can be seen in FIG. 12 that the front plate 68C has a cutout means 68C' through which a portion of the time indicating drum means 23C, 24C and 25C project and during the assembly of the clock construction 20C, as well as the clock construction 20 previously described, the minute drum 23C is adjusted in the cutout 68C' so that a particular numeral thereon will be properly exposed at the windows of the clock construction 20C in a properly aligned relation with the numerals on the ten minute drum 24 and hour drum 25 and such adjusting movement of the drum 23C causes the shaft means 63C of the Geneva clutch means 56C to rotate whereby it is desired to hold the spring means 80C the pinion 55C stationary at this time.

Accordingly, the hub portion 86C of the plate part 85C of the spring means 80C is slotted at 101 to permit the same to be frictionally rotated on the hub part 102 of the spring retainer 87C as illustrated.

In addition, the plate part 85C of the spring 80C is provided with a plurality of openings 103 therethrough which are disposed in a circular array about the hub 86C and are adapted to each be serially aligned with a suitable access means or opening 104 formed through the front plate 68C of the clock construction 20C.

In this manner a suitable holding pin means 105 can have an end 106 thereof inserted through the opening means or access means 104 of the plate 68C and be received in one of the openings 103 of the spring 80C so as to hold the spring 80C from rotation thereof. Thereafter, with the Geneva gear 55C in the idle mode, the minute drum 23C can be adjusted upwardly in FIG. 12 to properly align one of its numerals with the window means. Thereafter, the holding pin 105 can be retracted from the aligned openings 104 and 103 whereby the spring means 80C will be retained in the proper position on the spring retainer 87C by the frictional holding force of the hub 86C in the manner previously described for the clock construction 20.

As illustrated in FIG. 18, the spring means 80C can be formed from a flat blank of material 107 that has been suitably stamped and cut as illustrated which will be subsequently bent and folded to form the spring means 80C in the configuration illustrated in the drawings and in a manner similar to the spring means 80 previously described.

The other parts of the Geneva clutch means 56C of the clock contruction 20C are substantially the same as the similar parts of the Geneva clutch 56 previously described except that four of the teeth 73C extend completely along the corners of the section 71C and thereby actually define the corners 76C thereof whereby the section 71C no longer has the flat sides 75C thereof directly engaged by the legs 81C. Thus, the section 71C is similar to the section 71'' of the prior art device illustrated in FIG. 11.

Figure 15:
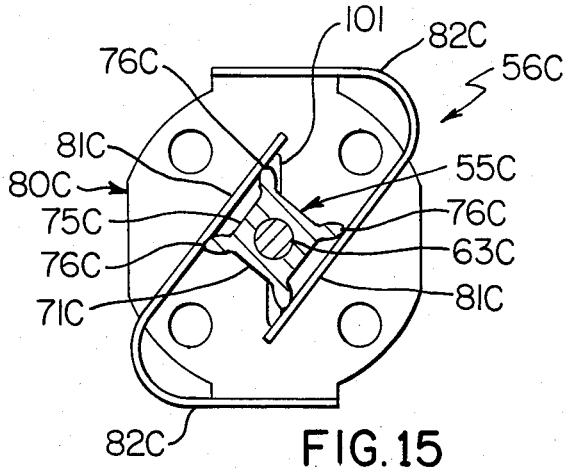
FIG. 15 is a view similar to FIG. 4 and is taken on line 15—15 of FIG. 13.
Figure 16:
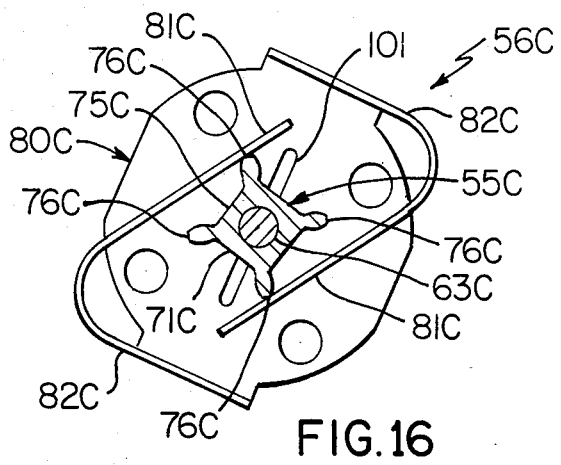
FIG. 16 is a view similar to FIG. 15 and illustrates the Geneva clutch means in another operating condition thereof.

Nevertheless, it can be seen from FIGS. 15 and 16 that the legs 81C operate on opposed sides of the section 71C through the corner means 76C thereof to provide for the unique long and short moment arm operation as previously described.

In particular, it can be seen that during normal driving operation of the clock construction 20C, there is a tendency of the multi-sided section 71C to have the corners 76C thereof that are disposed closer to the fixed end means 82C of the leaf spring members 81C to tend to separate the spring members 81C from each other so that relatively short lever arms are provided by the leaf spring members 81C between those corners 76C and the fixed ends 82C as illustrated in FIG. 15. In this manner, substantial torque can be transmitted by the Geneva pinion 55C through the leaf spring members 81C to the shaft 63C to cause the shaft 63C to rotate therewith in the manner previously described to operate the drum means 23C–25C as previously described.

However, should the operator desire to reset the time indicated by the drum means 23C–25C, the spring means 80C is rotated in a clockwise direction about the multi-sided section 71C in the manner illustrated in FIG. 16 so as to rotate the shaft 63C independently of the Geneva pinion 55C as previously described. Such rotation of the spring means 80C in a clockwise direction about the multi-sided section 71C as illustrated in FIG. 16 causes the leaf spring members 81C to act on the corner means 76C of the respective sides of the multi-sided section 71C and because the shoulders 76C that are acted on are the ones disposed furthest from the fixed ends 82C of the respective members 81C, relatively long moment arms are provided between those corners 76C and the fixed ends 82C of the leaf spring members 81C so as to provide for the least amount of force require to deflect the spring members 81C to permit the spring means 80C to be rotated in a clockwise direction relative to the Geneva pinion 55 in the manner illustrated in FIG. 16.

In this manner, the resetting mode of the Geneva clutch means 56C of this invention requires a reduced effort whereas during normal operation of the Geneva clutch means 56C by the motor means of the clock construction 20C, the greatest amount of torque is provided by the other corner 76C of the multi-sided member 71C acting on the leaf members 81C and thereby acting through short moment arms of the leaf spring members 81C in the manner previously described.

Therefore, it can be seen that this invention not only provides a new clock construction and a new Geneva clutch means therefor, but also this invention provides new methods of making such a clock construction and such a Geneva clutch means.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a clock construction comprising a frame means, drive means carried by said frame means, time indicating means carried by said frame means, and a Geneva clutch means carried by said frame means and operatively interconnecting said drive means to said time indicating means so that said drive means can drive said time indicating means in a timed sequence thereof, said clutch means comprising a shaft rotatably carried by said frame means, a pair of leaf spring means each having opposed end means with a longitudinal axis therebetween, one of said opposed end means of each said leaf spring means being fixed to said shaft so that said leaf spring means rotate in unison therewith, and a Geneva pinion rotatably disposed on said shaft and having a multi-sided section engaged by said leaf spring means to tend to cause said shaft to rotate in unison with said pinion about an axis of rotation as said pinion is being rotated by said drive means, each said leaf spring means having said longitudinal axis thereof disposed substantially transverse to said axis of rotation of said shaft and said pinion, the improvement wherein the other opposed end means of said leaf spring means extend in opposite directions relative to each other.

2. A clock construction as set forth in claim 1 wherein each said leaf spring means has a medial portion thereof disposed between said opposed end means thereof, said medial portions being the parts of said leaf spring means that engage said section of said pinion.

3. A clock construction as set forth in claim 2 wherein said section of said pinion has a plurality of sides disposed that the same and being generally transverse to said axis of rotation, said medial portions of said leaf spring means being adapted to respectively engage two of said sides of said section.

4. A clock construction as set forth in claim 3 wherein said two sides of said section are on opposite sides of said section.

5. A clock construction as set forth in claim 3 wherein each side of said section of said pinion joins an adjacent said side to define a corner means therewith, said drive means of said clock construction tending to rotate said pinion on said shaft relative to said leaf spring means in a direction that tends to cause said corner means of said two sides of said section that are respectively closest to said one end means of said leaf spring means to move said leaf spring means in a direction away from said axis of rotation.

6. A clock construction as set forth in claim 5 and including a manually operable means operatively interconnected to said shaft to rotate said shaft independently of said pinion in a direction that will cause said leaf spring means to act on said corner means of said two sides of said section that are respectively farthest from said one end means of said leaf spring means.

7. A clock construction as set forth in claim 1 wherein said leaf spring means have said one opposed end means thereof secured together.

8. A clock construction as set forth in claim 6 wherein said leaf spring means comprise a one-piece member.

9. In a Geneva clutch means for a clock construction comprising a frame means carrying a drive means and a time indicating means, said Geneva clutch means being adapted to be carried by said frame means and operatively interconnect said drive means to said time indicating means in a timed sequence thereof, said clutch means comprising a shaft adapted to be rotatably carried by said frame means, a pair of leaf spring means each having opposed end means with a longitudinal axis therebetween, one of said opposed end means of each said leaf spring means being fixed to said shaft so that said leaf spring means rotate in unison therewith, and a Geneva pinion rotatably disposed on said shaft and having a multi-sided section engaged by said leaf spring means to tend to cause said shaft to rotate in unison with said pinion about an axis of rotation as said pinion is being rotated by said drive means, each said leaf spring means having said longitudinal axis thereof disposed substantially transverse to said axis of rotation of said shaft and said pinion, the improvement wherein the other opposed end means of said leaf spring means extend in opposite directions relative to each other.

10. A Geneva clutch means as set forth in claim 9 wherein each said leaf spring means has a medial portion thereof disposed between said opposed end means thereof, said medial portions being the parts of said leaf spring means that engage said section of said pinion.

11. A Geneva clutch means as set forth in claim 10 wherein said section of said pinion has a plurality of sides disposed about the same and being generally transverse to said axis of rotation, said medial portions of said leaf spring means being adapted to engage two of said sides of said section.

12. A Geneva clutch means as set forth in claim 11 wherein said two sides of said section are on opposite sides of said section.

13. A Geneva clutch means as set forth in claim 9 wherein said leaf spring means have said one opposed end means thereof secured together.

14. A Geneva clutch means as set forth in claim 13 wherein said leaf spring means comprise a one-piece member.

15. In a method of making a clock construction comprising the steps of providing a frame means, disposing drive means so as to be carried by said frame means, disposing time indicating means so as to be carried by said frame means, forming a Geneva clutch means to be carried by said frame means and operatively interconnect said drive means to said time indicating means so that said drive means can drive said time indicating means in a timed sequence thereof, forming said clutch means to comprise a shaft rotatably carried by said frame means and a pair of leaf spring means each having opposed end means with a longitudinal axis therebetween, fixing one of said opposed end means of each said leaf spring means to said shaft so that said leaf spring means rotate in unison therewith, disposing a Geneva pinion of said clutch means so as to be rotatable on said shaft and have a multi-sided section engaged by said leaf spring means to tend to cause said shaft to rotate in unison with said pinion about an axis of rotation as said pinion is being rotated by said drive means, and disposing each said leaf spring means so as to have said longitudinal axis thereof substantially transverse to said axis of rotation of said shaft and said pinion, the improvement comprising the step of disposing the other end means of said leaf spring means so as to extend in opposite directions relative to each other.

16. In a method of making a Geneva clutch means for a clock construction comprising a frame means carrying a drive means and a time indicating means, said method comprising the steps of forming said Geneva clutch means to be adapted to be carried by said frame means and operatively interconnect said drive means to said time indicating means so that said drive means can drive said time indicating means in a timed sequence thereof, forming said clutch means to comprise a shaft to be rotatably carried by said frame means and a pair of leaf spring means each having opposed end means with a longitudinal axis therebetween, fixing one of said opposed end means of each said leaf spring means to said shaft so that said leaf spring means rotate in unison therewith, disposing a Geneva pinion of said clutch means so as to be rotatable on said shaft and have a multi-sided section engaged by said leaf spring means to tend to cause said shaft to rotate in unison with said pinion about an axis of rotation as said pinion is being rotated by said drive means, and disposing each said leaf spring means so as to have said longitudinal axis thereof substantially transverse to said axis of rotation of said shaft and said pinion, the improvement comprising the step of disposing the other end means of said leaf spring means so as to extend in opposite directions relative to each other.

17. In a clock construction comprising a frame means having a front panel means, drive means carried by said frame means, time indicating means carried by said frame means, and a Geneva clutch means carried by said frame means behing said front panel means thereof and operatively interconnecting said drive means to said time indicating means so that said drive means can drive said time indicating means in a timed sequence thereof, said clutch means comprising a shaft rotatably carried by said frame means, leaf spring means being normally frictionally fixed to said shaft so that said leaf spring means normally rotates in unison therewith, and a Geneva pinion rotatably disposed on said shaft and having a multi-sided section engaged by said leaf spring means to tend to cause said shaft to rotate in unison with said pinion about an axis of rotation as said pinin is being rotated by said drive means, the improvement wherein said frame means has externally accessible access means in said front panel means thereof for permitting the holding of said spring means while said shaft is rotated relative to the thus held spring means by an adjustment being made of said time indicating means that causes such rotation of said shaft.

18. A clock construction as set forth in claim 17 wherein said access means comprises an opening means through said front panel means of said frame means.

19. A clock construction as set forth in claim 18 wherein said spring means has a holding means that is adapted to be aligned with said opening means in said front panel means of said frame means.

20. A clock construction as set forth in claim 19 wherein said holding means of said spring means comprises opening means in said spring means that permits a holding pin means to be inserted therein .

21. A clock construction as set forth in claim 20 wherein said opening means of said spring means comprises a plurality of openings therein each of which is adapted to receive said holding pin means therein.

22. A clock construction as set forth in claim 21 wherein said spring means has an aperture therethrough that receives said shaft therein, said openings being disposed in a circular array that is substantially concentric about said aperture.

23. A clock construction as set forth in claim 22 wherein said shaft has means that frictionally engages said spring means at said aperture thereof to normally frictionally interconnect said spring means and said shaft together for rotation in unison thereof.

24. In a method of making a clock construction comprising the steps of providing a frame means, disposing drive means so as to be carried by said frame means, disposing time indicating means so as to be carried by said frame means, forming a Geneva clutch means to be carried by said frame means behind a front panel means of said frame means and operatively interconnect said drive means to said time indicating means so that said drive means can drive said time indicating means in a timed sequence thereof, forming said clutch means to comprise a shaft rotatably carried by said frame means and a leaf spring means, frictionally fixing said spring means to said shaft so that said leaf spring means normally rotates in unison therewith, and disposing a Geneva pinion of said clutch means so as to be rotatable on said shaft and have a multi-sided section engaged by said leaf spring means to tend to cause said shaft to rotate in unison with said pinion about an axis of rotation as said pinion is being rotated by said drive means, the improvement comprising the step of forming said frame means with an externally accessible access means in said front panel means thereof to permit the holding of said spring means while said shaft is rotated relative to the thus held spring means by an adjustment being made to said time indicating means that causes such rotation of said shaft.

* * * * *